US011485921B2

(12) United States Patent
Aristov

(10) Patent No.: US 11,485,921 B2
(45) Date of Patent: Nov. 1, 2022

(54) FUEL COMPOSITION OF DIESEL FUEL

(71) Applicant: Andrey Viacheslavovich Aristov, Moscow (RU)

(72) Inventor: Andrey Viacheslavovich Aristov, Moscow (RU)

( * ) Notice: Subject to any disclaimer, the term of this patent is extended or adjusted under 35 U.S.C. 154(b) by 0 days.

(21) Appl. No.: 17/290,424

(22) PCT Filed: Jan. 17, 2020

(86) PCT No.: PCT/RU2020/000021

§ 371 (c)(1),
(2) Date: Apr. 30, 2021

(87) PCT Pub. No.: WO2020/153877

PCT Pub. Date: Jul. 30, 2020

(65) Prior Publication Data

US 2021/0395629 A1 Dec. 23, 2021

(30) Foreign Application Priority Data

Jan. 22, 2019 (RU) ..... RU2019101618
Apr. 26, 2019 (RU) ..... RU2019112856

(51) Int. Cl.

| | |
|---|---|
| ***C10L 1/08*** | (2006.01) |
| ***C10L 1/185*** | (2006.01) |
| ***C10L 1/188*** | (2006.01) |
| ***C10L 10/08*** | (2006.01) |
| ***C10L 10/12*** | (2006.01) |

(52) U.S. Cl.

CPC ..... *C10L 1/08* (2013.01); *C10L 1/185* (2013.01); *C10L 1/188* (2013.01); *C10L 10/08* (2013.01); *C10L 10/12* (2013.01); *C10L 2200/029* (2013.01); *C10L 2200/0446* (2013.01); *C10L 2270/026* (2013.01); *C10L 2300/20* (2013.01)

(58) Field of Classification Search

CPC .... C10L 1/08; C10L 1/185; C10L 1/88; C10L 10/08; C10L 10/12; C10L 2200/029; C10L 2200/0446; C10L 2270/026; C10L 2300/20

See application file for complete search history.

(56) References Cited

U.S. PATENT DOCUMENTS

2003/0159337 A1* 8/2003 Davenport ..... C10L 10/08 44/347
2007/0240361 A1* 10/2007 Clayton ..... C10L 1/143 44/385
2011/0099979 A1* 5/2011 Xu ..... C10L 1/1811 44/322
2015/0368576 A1* 12/2015 Boonwatsakul ..... C10L 1/18 44/411

FOREIGN PATENT DOCUMENTS

CN 101643672 A 2/2010
RU 2529678 C1 9/2014
WO WO2016/174178 A1 11/2016

OTHER PUBLICATIONS

International Search Report dated Apr. 24, 2020, Russian International Searching Authority.

* cited by examiner

*Primary Examiner* — Cephia D Toomer
(74) *Attorney, Agent, or Firm* — Burr & Forman LLP; Jeffrey H. Kamenetsky

(57) ABSTRACT

The invention relates to a fuel composition based on a diesel fraction, having a sulphur content of less than 10 mg/kg with the boiling range of 180-360° C., characterized in that said fuel composition contains organic peroxides as ignition promoters, which are selected from the group: di-tert-butyl peroxide, 1,1-di-(tert-butylperoxy)cyclohexane, dicumyl peroxide, tert-butyl cumyl peroxide, isobutyl cumyl peroxide, n-butyl cumyl peroxide, isopropyl cumyl peroxide, ethyl cumyl peroxide and methyl cumyl peroxide, and contains an anti-wear additive based on carboxylic acids having the following ratio of components, wt %: 0.01-0.5 organic peroxide, 0.005-0.1 anti-wear additive, and up to 100 being the diesel fraction. The proposed diesel fuel composition allows producing diesel fuel which meets quality performance requirements.

1 Claim, No Drawings

FUEL COMPOSITION OF DIESEL FUEL

CROSS-REFERENCE TO RELATED APPLICATION

This application is a national stage application, filed under 35 U.S.C. § 371, of International Patent Application No. PCT/RU2020/000021, filed Jan. 17, 2020, which claims priority to Russian patent application 2019112856, filed Apr. 26, 2019 and Russian patent application 2019101618, filed Jan. 22, 2019, which are herewith incorporated by reference in their entirety.

TECHNICAL FIELD

The invention relates to petroleum refining and petrochemistry, namely, to a diesel fuel composition.

BACKGROUND

Diesel fuel remains the most highly-demanded petroleum product both in the worldwide and in the Russian markets. It is mostly consumed by railway, water and road freight transportation, as well as by various electric generators, military and agricultural equipment.

Modern diesel fuel is a deeply hydroprocessed product having various additives, which provide the required environmental and operational properties.

A very important quality in the parameters of diesel fuel that characterizes its volatility is the cetane number, and its optimal value provides good starting properties of fuel, as well as a lesser amount of noxious emissions along with exhaust gases.

In order to enhance the ignition of diesel fuels, ignition promoters are used. Nowadays, additives based on 2-ethylhexyl nitrate are used as the ignition promoters in Russia. However, along with advantages, 2-ethylhexyl nitrate has a number of disadvantages: it is explosion-dangerous, may decompose upon explosion, accelerates the fuel oxidation, comprises nitrogen, corrosive relative to metals, and deteriorates antiwear properties of diesel fuel. It is known that in presence of the ignition promoter based on 2-ethylhexyl nitrate, the concentration of the antiwear additive must be increased in order to achieve the required fuel lubricity. Also, investigators note that the cetane numbers of diesel fuels are reduced in the process of their storage, which is explained by decomposition (by hydrolysis) of 2-ethylhexyl nitrate in the presence of water.

Abroad in view of the limitation of the nitrogen content in diesel fuel, the California Air Resources Board (CARB) implies a successive transition to output of diesel fuels with peroxides.

An additive for a low-sulfur diesel fuel is known in order to reduce the fuel consumption in a diesel engine, characterized in that it comprises peroxide in the amount of from 0.001 wt. % to 10 wt. %.

(Application WO 2016/174176 A1, 2016).

The additive disadvantage lies in an insufficient efficiency in terms of increase of lubricity the diesel fuel lubricity that does not allow the enhancement of this parameter up to the standard requirements.

(U.S. Pat. No. 5,314,511, 1994).

The composition disadvantage lies in a high sulfur content in the fuel composition being up to 500 mg/kg of sulfur, while nowadays, modern diesel fuels comprise up to 10 mg/kg of sulfur. When testing the obtained samples of the fuel composition, an influence of the additive onto the fuel consumption was studied and a toxicity of emissions was evaluated, i.e. environmental properties were evaluated, rather than operational ones.

The closest analogue of the suggested fuel composition is a diesel fuel formulation comprising an additive of premixed cyclohexyl nitrate or 2-ethylhexyl nitrate and peroxides selected from a group of: ditert-butyl peroxide, dicumyl peroxide, cumyl hydroperoxide under a mass ratio of said components from 3:1 to 1:3 in the amount of the additive of 0.1-0.5 wt. %.

(RU Patent No. 2451718, 2012).

This composition disadvantage lies in a presence of the diesel fuel produced according to the GOST 305-82 that is characterized by an increased content of sulfuric compounds (up to 0.05 wt. %). Such diesel fuels have good lubricating properties and do not require adding of antiwear additives. Also, this fuel is produced to supply according to the state defense order only and for export. Also, the formulation of this fuel composition comprises nitrates that does not allow reduction of the content of nitrogen oxides in exhaust gases to the minimum.

SUMMARY

In one aspect of the invention, a fuel composition is provided, where the fuel composition based on a diesel fraction having a sulfur content of less than 10 mg/kg with boiling points in the range of 180-360° C., characterized in that it comprises ignition promoters such as organic peroxides selected from a group of: di-tert-butyl peroxide, 1,1-di (tert-butyl peroxy)cyclohexane, dicumyl peroxide, and an antiwear additive based on carboxylic acids having the following ratio of components, wt. %:

organic peroxide from 0.01 to 0.5,
antiwear additive from 0.005 to 0.1,
diesel fraction up to 100.

In another aspect of the invention, a fuel composition is provided where the fuel composition is based on a diesel fraction having a sulfur content of less than 10 mg/kg with boiling points in the range of 180-360° C., characterized in that it comprises ignition promoters such as organic peroxides selected from a group of: tert-butyl cumyl peroxide, isobutyl cumyl peroxide, n-butyl cumyl peroxide, and an antiwear additive based on carboxylic acids having the following ratio of components, wt. %:

organic peroxide from 0.01 to 0.5,
antiwear additive from 0.005 to 0.1,
fraction up to 100.

In another aspect of the invention, a fuel composition is provided where the fuel composition is based on a diesel fraction having a sulfur content of less than 10 mg/kg with boiling points in the range of 180–360° C., characterized in that it comprises ignition promoters such as organic peroxides selected from a group of: isopropyl cumyl peroxide, ethyl cumyl peroxide, methyl cumyl peroxide, and an antiwear additive based on carboxylic acids having the following ratio of components, wt. %:

organic peroxide from 0.01 to 0.5,
antiwear additive from 0.005 to 0.1
diesel fraction up to 100.

DETAILED DESCRIPTION

A task of the invention is to create a fuel composition of a low-sulfur diesel fuel using organic peroxides as ignition promoters that could meet the requirements of GOST 32511-2013, GOST R 52368-2005, EN 590, GOST R 55475-2013, TR CU 013/2011.

The posed task is solved by the proposed diesel fuel composition including a diesel fraction with a sulfur content of less than 10 mg/kg with boiling points in the range of 180-360° C., characterized in that it comprises a synergistic combination of an organic peroxide as an ignition promoter (up to 0.5 wt. %) and an antiwear additive based on carboxylic acids (up to 0.1 wt. %).

In order to prepare a basic diesel fuel, the following components are used: ultra-low-sulfur (having the sulfur content of less than 10 mg/kg)=hydroprocessed diesel fraction and/or a hydrocracking diesel fraction with boiling points in the range of 180-360° C.

The proposed diesel fuel is prepared using a standard equipment by mixing components and additives until a homogeneous product is obtained.

Characteristics of the diesel fuel components, which are used in examples to support the proposed invention, are shown in Table 1.

As examples of the proposed invention, the diesel fuel compositions were prepared, with their test results stated in Tables 2, 3 and 4, wherein results of testing the diesel fuel comprising 2-ethylhexyl nitrate as the ignition promoter are provided for comparison.

The test results show that the diesel fuel samples comprising organic peroxide as the ignition promoter are highly competitive, in terms of an increment of the cetane numbers, with diesel fuels comprising 2-ethylhexyl nitrate as the ignition promoter.

The combination of the additives' package in the formulation of the diesel fuel, where the package comprises an organic peroxide and the antiwear additive based on carboxylic acids, has a synergistic effect in terms of the lubricity of the fuel. Table 2 states experimental values of the corrected wear scar diameter according to the HFRR method for each diesel fuel sample. For comparison, the tables also state data regarding the lubricity of the diesel fuel samples, which comprise 2-ethylhexyl nitrate as an ignition promoter, while the formulation and concentration of the antiwear additive remain unchanged. Unexpectedly, it has been found that the peroxide additive in the package with the antiwear additive based on carboxylic acids does not negatively affect the lubricity of the diesel fuel as opposed to 2-ethylhexyl nitrate. The distinctive feature of the invention is the synergistic effect that is observed in case of the combined use of the organic peroxides as ignition promoters and the antiwear additive based on carboxylic acids in the diesel fuel (having the sulfur content of less than 10 mg/kg).

It is known that 2-ethylhexyl nitrate facilitates formation of resinous compounds in diesel fuels and acceleration of the fuel oxidation. The obtained data (Table 2) allow to conclude that the ignition promoters based on organic peroxides have less impact onto formation of a residue. This is advantageous as compared to the ignition promoters based on 2-ethylhexyl nitrate. The number of adsorption resins in fuels comprising ignition promoters based on organic peroxides and 2-ethylhexyl nitrate are commensurable and fall within limits of the method reproducibility.

The effective combination of the ignition promoters based on organic peroxides and the antiwear additive based on carboxylic acids may allow to reduce the concentration of the latter one. This is an advantage as compared to the ignition promoters based on 2-ethylhexyl nitrate, which, when they are used, make it necessary to increase the concentration of the antiwear additive in order to achieve the required lubricity.

Therefore, the proposed diesel fuel composition allows to produce the diesel fuel that meets the requirements of GOST 32511-2013, GOST R 52368-2005, EN 590, GOST R 55475-2013 and TR CU 013/2011 in terms of quality parameters.

TABLE 1

Main characteristics of the diesel fuel components

| Parameter | Hydroprocessed diesel fraction | Hydrocracking diesel fraction |
|---|---|---|
| Cetane number, un. | 46.2 | 55.7 |
| Lubricity: the corrected parameter of the wear scar diameter at 60° C., μm | 564 | 635 |
| Fractional formulation: distilled up to 180° C., vol. % | 9.5 | 1.1 |
| distilled up to 360° C., vol. % | 97.4 | 98.3 |
| Overall sulfur content, mg/kg | 10 | 5.1 |

Tables 2, 3, 4—The component formulation of the samples of the proposed diesel fuel composition comprising the synergistic composition of the organic peroxide and the antiwear additive based on carboxylic acids, and results of its testing in comparison with the composition comprising 2-ethylhexyl nitrate.

TABLE 2

| | Content of the components, wt. %, /number of sample/ | | | | | | | | | |
|---|---|---|---|---|---|---|---|---|---|---|
| Component | 1 | 2 | 2a | 2b | 3 | 3a | 4 | 4a | 4b | 5 |
| Hydroprocessed diesel fraction | 99.97 | 99.77 | 99.47 | 99.5 | 99.77 | 99.7 | 99.77 | 99.77 | 99.47 | 99.77 |
| Hydrocracking diesel fraction | | | | | | | | | | |
| Antiwear additive | 0.03 | 0.03 | 0.03 | — | 0.03 | 0.1 | 0.005 | 0.03 | 0.03 | 0.03 |
| Di-tert-butyl peroxide | — | 0.2 | 0.5 | 0.5 | — | — | — | — | — | — |
| 1,1-di (tert-butyl peroxy)cyclohexane | — | — | — | — | 0.2 | 0.2 | — | — | — | — |
| Dicumyl peroxide | — | — | — | — | — | — | 0.01 | 0.2 | 0.5 | — |
| 2-ethylhexyl nitrate | — | — | — | — | — | — | — | — | — | 0.2 |
| Parameter | Parameter value | | | | | | | | | |
| Lubricity: the corrected parameter of the wear scar diameter at 60° C., μm | 398 | 356 | 328 | 559 | 359 | 332 | 425 | 346 | 325 | 405 |

TABLE 2-continued

| | | | | | | | | | | |
|---|---|---|---|---|---|---|---|---|---|---|
| Cetane number, un. | 46.2 | 52.0 | 54.6 | 54.6 | 53.3 | 53.3 | 51.4 | 54.6 | 57.2 | 53.2 |
| Content of adsorption resins, mg per 100 $cm^3$ of the fuel | — | 692 | 705 | 698 | 805 | 867 | 769 | 785 | 803 | 744 |
| Overall residue mass, ml/100 ml [2)] | — | 0.300 | 0.400 | 0.375 | 0.675 | 0.725 | 0.725 | 0.700 | 0.675 | 0.750 |

| Component | Content of the components, wt. %, /number of sample/ 6 | 7 | 8 | 8a | 8 | 10 | Requirements of GOST 32511-2013, GOST R 52368-2005 and TR CU 013/2011 |
|---|---|---|---|---|---|---|---|
| Hydroprocessed diesel fraction | | | | | | | |
| Hydrocracking diesel fraction | 99.97 | 99.77 | 99.77 | 99.7 | 99.77 | 99.77 | |
| Antiwear additive | 0.03 | 0.03 | 0.03 | 0.1 | 0.03 | 0.03 | |
| Di-tert-butyl peroxide | — | 0.2 | — | — | — | — | |
| 1,1-di (tert-butyl peroxy)cyclohexane | — | — | 0.2 | 0.2 | — | — | |
| Dicumyl peroxide | — | — | — | — | 0.2 | — | |
| 2-ethylhexyl nitrate | — | — | — | — | — | 0.2 | |
| Parameter | Parameter value | | | | | | |
| Lubricity: the corrected parameter of the wear scar diameter at 60° C., μm | 404 | 418 | 354 | 337 | 380 | 467 | not more than 460 |
| Cetane number, un. | 55.7 | 61.7 | 62.2 | 62.2 | 63.2 | 62.2 | not less than 51 |
| Content of adsorption resins, mg per 100 $cm^3$ of the fuel | — | 113 | 263 | 328 | 236 | 110 | not more than 2500 [1)] |
| Overall residue mass, ml/100 ml [2)] | — | 0.450 | 0.550 | 0.650 | 0.575 | 0.625 | not more than 2 |

Note:

[1)] Determined according to STO 11605031-056, the regulation is established within the MCO (MKO).

[2)] Determined according to STO 11605031-077-2013, the method is qualified, it is not included into the ND for the diesel fuel

TABLE 3

| Component | 1 | Content of the components, wt. %, /number of sample/ 2 | 2a | 2b | 3 | 3a | 4 | 4a | 4b | 5 |
|---|---|---|---|---|---|---|---|---|---|---|
| Hydroprocessed diesel fraction | 99.97 | 99.77 | 99.77 | 99.5 | 99.77 | 99.7 | 99.77 | 99.77 | 99.47 | 99.77 |
| Hydrocracking diesel fraction | | | | | | | | | | |
| Antiwear additive | 0.03 | 0.03 | 0.03 | — | 0.03 | 0.1 | 0.005 | 0.03 | 0.03 | 0.03 |
| Tert-butyl cumyl peroxide | — | 0.2 | 0.5 | 0.5 | — | — | — | — | — | — |
| Isobutyl cumyl peroxide | — | — | — | — | 0.2 | 0.2 | — | — | — | — |
| n-Butyl cumyl peroxide | — | — | — | — | — | — | 0.01 | 0.2 | 0.5 | — |
| 2-ethylhexyl nitrate | — | — | — | — | — | — | — | — | — | 0.2 |
| Parameter | | | | | Parameter value | | | | | |
| Lubricity: the corrected parameter of the wear scar diameter at 60° C., μm | 398 | 356 | 328 | 559 | 359 | 332 | 425 | 346 | 325 | 405 |
| Cetane number, un. | 46.2 | 52.0 | 54.6 | 54.6 | 53.3 | 53.3 | 51.4 | 54.6 | 57.2 | 53.2 |
| Content of adsorption resins, mg per 100 $cm^3$ of the fuel | — | 692 | 705 | 698 | 805 | 867 | 769 | 785 | 803 | 744 |
| Overall residue mass, mL/100 ml [2)] | — | 0.300 | 0.400 | 0.375 | 0.675 | 0.725 | 0.725 | 0.700 | 0.675 | 0.750 |

| Component | Content of the components, wt. %, /number of sample/ 6 | 7 | 8 | 8a | 8 | 10 | Requirements of GOST 32511-2013, GOST R 52368-2005 and TR CU 013/2011 |
|---|---|---|---|---|---|---|---|
| Hydroprocessed diesel fraction | | | | | | | |
| Hydrocracking diesel fraction | 99.97 | 99.77 | 99.47 | 99.7 | 99.77 | 99.77 | |
| Antiwear additive | 0.03 | 0.03 | 0.03 | 0.1 | 0.03 | 0.03 | |
| Tert-butyl cumyl peroxide | — | 0.2 | — | — | — | — | |
| Isobutyl cumyl peroxide | — | — | 0.2 | 0.2 | — | — | |
| n-Butyl cumyl peroxide | — | — | — | — | 0.2 | — | |
| 2-ethylhexyl nitrate | — | — | — | — | — | 0.2 | |
| Parameter | Parameter value | | | | | | |
| Lubricity: the corrected parameter of the wear scar diameter at 60° C., μm | 404 | 418 | 354 | 337 | 380 | 467 | not more than 460 |

TABLE 3-continued

| | | | | | | | |
|---|---|---|---|---|---|---|---|
| Cetane number, un. | 55.7 | 61.7 | 62.2 | 62.2 | 63.2 | 62.2 | not less than 51 |
| Content of adsorption resins, mg per 100 $cm^3$ of the fuel | — | 113 | 263 | 328 | 236 | 110 | not more than 2500 [1] |
| Overall residue mass, mL/100 ml [2] | — | 0.450 | 0.550 | 0.650 | 0.575 | 0.625 | not more than 2 |

Note:
[1] Determined according to STO 11605031-056, the regulation is established within the MCO (MKO).
[2] Determined according to STO 11605031-077-2013, the method is qualified, it is not included into the ND for the diesel fuel

TABLE 4

| | Content of the components, wt. %, /number of sample/ | | | | | | | | | |
|---|---|---|---|---|---|---|---|---|---|---|
| Component | 1 | 1a | 2 | 2a | 2b | 2c | 2d | 3 | 3a | 3b |
| Hydroprocessed diesel fraction | 99.97 | | 99.77 | 99.47 | 99.5 | | | 99.77 | 99.7 | |
| Hydrocracking diesel fraction | | | | | | | | | | |
| Antiwear additive | 0.03 | 0.03 | 0.03 | 0.03 | 0.03 | 0.03 | 0.03 | 0.03 | 0.1 | 0.1 |
| Isopropyl cumyl peroxide | — | 0.2 | — | — | — | — | — | — | — | — |
| Ethyl cumyl peroxide | — | — | — | — | — | — | 0.2 | — | — | — |
| Methyl cumyl peroxide | — | — | — | — | — | — | — | — | — | — |
| 2-ethylhexyl nitrate | — | — | — | — | — | — | — | — | — | — |
| Parameter | | | | | Parameter value | | | | | |
| Lubricity: the corrected parameter of the wear scar diameter at 60° C., μm | 398 | 372 | 356 | 328 | 559 | 343 | 362 | 359 | 332 | 341 |
| Cetane number, un. | 46.2 | 52.1 | 52.0 | 54.6 | 54.6 | 54.6 | 53.5 | 53.3 | 53.3 | 53.5 |
| Content of adsorption resins, mg per 100 $cm^3$ of the fuel | — | 706 | 692 | 705 | 698 | 732 | 728 | 805 | 867 | 832 |
| Overall residue mass, ml/100 ml [2] | — | 0.350 | 0.300 | 0.400 | 0.375 | 0.425 | 0.400 | 0.675 | 0.725 | 0.625 |

| | Content of the components, wt. %, /number of sample/ | | | | | | | | Requirements of GOST 32511-2013, GOST R 52368-2005 and TR CU |
|---|---|---|---|---|---|---|---|---|---|
| Component | 3c | 4 | 4a | 4b | 4c | 5 | 9 | 10 | 013/2011 |
| Hydroprocessed diesel fraction | | 99.77 | 99.77 | 99.47 | | 99.77 | | | |
| Hydrocracking diesel fraction | | | | | | | 99.77 | 99.77 | |
| Antiwear additive | 0.1 | 0.005 | 0.03 | 0.03 | 0.03 | 0.03 | 0.03 | 0.03 | |
| Isopropyl cumyl peroxide | — | — | — | — | — | — | — | — | |
| Ethyl cumyl peroxide | — | — | — | — | — | — | — | — | |
| Methyl cumyl peroxide | 0.2 | — | — | — | — | — | — | — | |
| 2-ethylhexyl nitrate | — | — | — | — | — | 0.2 | — | 0.2 | |
| Parameter | | | | Parameter value | | | | | |
| Lubricity: the corrected parameter of the wear scar diameter at 60° C., μm | 354 | 425 | 346 | 325 | 335 | 405 | 380 | 467 | not more than 460 |
| Cetane number, un. | 52.1 | 51.4 | 54.6 | 57.2 | 56.2 | 53.2 | 63.2 | 62.2 | not less than 51 |
| Content of adsorption resins, mg per 100 $cm^3$ of the fuel | 816 | 769 | 785 | 803 | 792 | 744 | 236 | 110 | not more than 2500 [1] |
| Overall residue mass, ml/100 ml [2] | 0.700 | 0.725 | 0.700 | 0.675 | 0.725 | 0.750 | 0.575 | 0.625 | not more than 2 |

Note:
[1] Determined according to STO 11605031-056, the regulation is established within the MCO (MKO).
[2] Determined according to STO 11605031-077-2013, the method is qualified, it is not included into the ND (НД) for the diesel fuel

What is claimed is:

1. A fuel composition based on a diesel fraction having a sulfur content of less than 10 mg/kg with boiling points in the range of 180-360° C., comprising as ignition promoters organic peroxides selected from a group of: isopropyl cumyl peroxide, ethyl cumyl peroxide, methyl cumyl peroxide, and an antiwear additive based on carboxylic acids having the following ratio of components, wt. %:

organic peroxide from 0.01 to 0.5;

antiwear additive from 0.005 to 0.1; and diesel fraction up to 100.

* * * * *